US011524863B2

(12) United States Patent
Weissbrod

(10) Patent No.: US 11,524,863 B2
(45) Date of Patent: Dec. 13, 2022

(54) SPOOL WITH MOVABLE HUB

(71) Applicant: Lincoln Global, Inc., Santa Fe Springs, CA (US)

(72) Inventor: Paul A. Weissbrod, South Euclid, OH (US)

(73) Assignee: Lincoln Global, Inc., Santa Fe Springs, CA (US)

( * ) Notice: Subject to any disclaimer, the term of this patent is extended or adjusted under 35 U.S.C. 154(b) by 99 days.

(21) Appl. No.: 17/198,425

(22) Filed: Mar. 11, 2021

(65) Prior Publication Data

US 2022/0289518 A1 Sep. 15, 2022

(51) Int. Cl.

| | |
|---|---|
| ***B65H 75/22*** | (2006.01) |
| ***B65H 75/24*** | (2006.01) |
| ***B65H 75/14*** | (2006.01) |

(52) U.S. Cl.

CPC ..... *B65H 75/241* (2013.01); *B65H 75/14* (2013.01); *B65H 75/22* (2013.01); *B65H 2701/534* (2013.01)

(58) Field of Classification Search

CPC ..... B65H 75/14; B65H 75/22; B65H 75/241; B65H 2701/534

See application file for complete search history.

(56) References Cited

U.S. PATENT DOCUMENTS

| | | | | |
|---|---|---|---|---|
| 4,454,998 | A | 6/1984 | Sarser | |
| 4,605,237 | A | 8/1986 | Torgrimson | |
| 4,756,488 | A * | 7/1988 | Cooke | B65H 75/14 242/613.5 |
| 5,354,012 | A * | 10/1994 | Vincent | B65H 54/12 242/118.41 |
| 5,718,397 | A * | 2/1998 | Stevens | B65H 75/14 242/608.8 |
| 8,727,262 | B2 | 5/2014 | Underbrink et al. | |
| 9,611,122 | B2 * | 4/2017 | Blette | B65H 49/205 |
| 2008/0061187 | A1 * | 3/2008 | Couchey | B65H 75/182 242/608.8 |
| 2010/0025521 | A1 * | 2/2010 | Snitselaar | B65H 75/22 242/608.2 |
| 2014/0283664 | A1 | 9/2014 | Blette et al. | |
| 2019/0193984 | A1 | 6/2019 | Temblador et al. | |

FOREIGN PATENT DOCUMENTS

WO 2015/011462 A1 1/2015

* cited by examiner

*Primary Examiner* — Sang K Kim

(74) *Attorney, Agent, or Firm* — Brad C. Spencer

(57) ABSTRACT

A spool has a first flange and a second flange. A barrel extends between the first flange and the second flange. A movable hub is located radially inward of the barrel. The barrel is axially wider than the movable hub and the movable hub is axially movable between a first operational position adjacent the first flange and a second operational position adjacent the second flange. The movable hub includes an axially-extending cantilevered detent arm forming a stop surface that limits axial movement of the movable hub toward one of the first flange and the second flange.

24 Claims, 8 Drawing Sheets

SPOOL WITH MOVABLE HUB

BACKGROUND OF THE INVENTION

Field of the Invention

The present invention relates to wound spools, and in particular spools for wire, such as welding wire.

Description of Related Art

It is known to wind welding wire onto a spool for payout during welding. The wire can be solid, flux cored, or metal cored and the wire is drawn off of the spool by a wire feeder. Example standard spool diameters are four inches, eight inches and twelve inches. Typically, eight inch diameter spools are 2.125 inches (54 mm) wide. Welding wire feeders have spindles that can be configured to support such spools, in particular spools with hubs having a standard width (e.g., 2.125 inches). The American Welding Society (AWS) promulgates standards for welding wire spool designs in the 8 inch diameter (200 mm) category. The standards provide for a larger sized spool having a greater wire capacity by increasing the width of the spool to 2.875 inches. However, the larger spool must have a hub that is similar to the 2.125 inch wide spool for compatibility with standard wire feeders. This results in 0.75 inch recess between the hub and the spool flange on one side of the spool. The recess makes the spool nonsymmetrical. Some wire feeders have two spindles extending in opposite directions 180° apart. If the hub of the welding wire spool is symmetrical, as in the case of a standard 2.125 inch wide, 8 inch diameter spool, the spool can be moved between the two spindles on opposite sides of a wire feeder without the spool having to be flipped (e.g., either spool flange can be oriented toward the inner portion of the spindles). Flipping the spool changes the wire payout direction, which may be undesirable. Moreover, if the hub of the welding wire spool is symmetrical, the payout direction can be changed if desired on a given spindle by simply flipping the spool around. However, if the hub is not symmetrical as in the case of higher capacity 8 inch diameter spools, the spool cannot be flipped on a given spindle (only one orientation is possible), and the spool must be flipped when moving it to a second spindle on the opposite side of the wire feeder (which changes the wire payout direction). Thus, the payout direction is limited when using higher capacity 8 inch diameter spools.

BRIEF SUMMARY OF THE INVENTION

The following summary presents a simplified summary in order to provide a basic understanding of some aspects of the devices, systems and/or methods discussed herein. This summary is not an extensive overview of the devices, systems and/or methods discussed herein. It is not intended to identify critical elements or to delineate the scope of such devices, systems and/or methods. Its sole purpose is to present some concepts in a simplified form as a prelude to the more detailed description that is presented later.

In accordance with one aspect of the present invention, provided is a spool having a first flange, a second flange, and a barrel extending between the first flange and the second flange. A movable hub is located radially inward of the barrel. The barrel is axially wider than the movable hub and the movable hub is axially movable between a first operational position adjacent the first flange and a second operational position adjacent the second flange. The movable hub includes an axially-extending cantilevered detent arm forming a stop surface that limits axial movement of the movable hub toward one of the first flange and the second flange.

In accordance with another aspect of the present invention, provided is a welding wire spool having a barrel, a first flange surrounding the barrel, and a second flange surrounding the barrel. A length of welding wire is wound on the barrel between the first flange and the second flange. A movable hub is located radially inward of the barrel. The barrel is axially wider than the movable hub and the movable hub is axially movable between a first operational position adjacent the first flange and a second operational position adjacent the second flange. The movable hub includes an axially-extending spring arm that applies a radial bias force to the barrel during axial movement of the movable hub.

In accordance with another aspect of the present invention, provided is a spool having a first flange, a second flange, and a barrel extending between the first flange and the second flange. A movable hub is located radially inward of the barrel. The barrel is axially wider than the movable hub and the movable hub is axially movable between a first operational position adjacent the first flange and a second operational position adjacent the second flange. The movable hub includes an axially-extending spring arm that applies a radial bias force to the barrel during axial movement of the movable hub. The barrel includes a stop surface that limits the axial movement of the movable hub toward one of the first flange and the second flange.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 2:
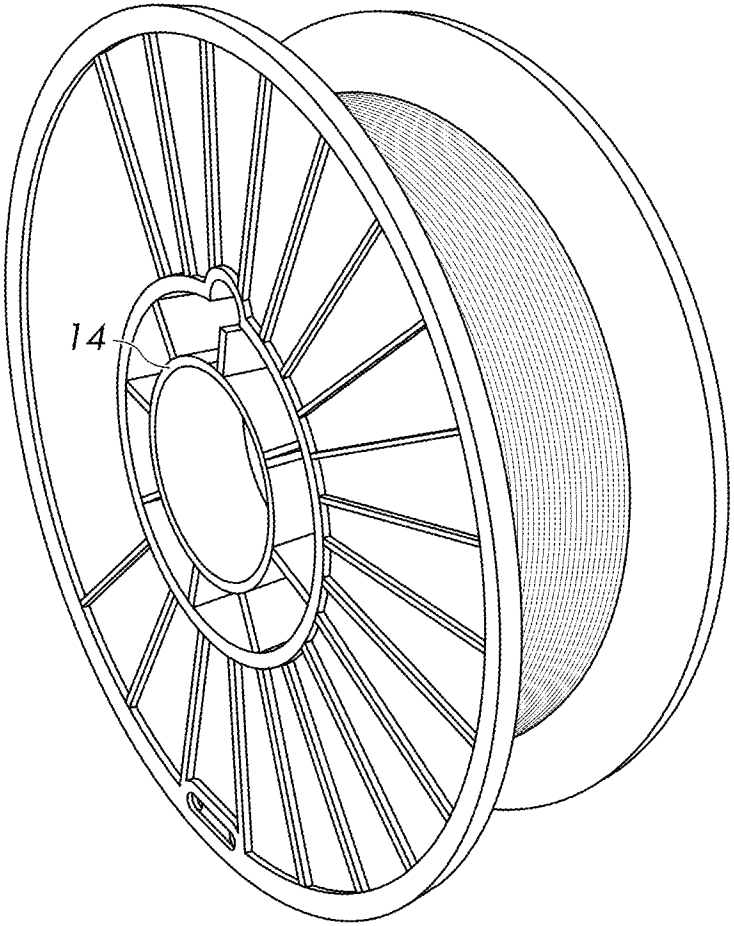
FIG. 2 shows a spool.

The present invention relates to wound spools for storing and dispensing wires, lines, threads and the like. One example spool is a welding wire spool. The present invention will be described in the context of a welding wire spool; however, it is to be appreciated that the spool embodiments described herein are applicable to spools for storing and dispensing various types of wires, lines, threads, and the like.

The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. Any disjunctive word or phrase presenting two or more alternative terms, whether in the description of embodiments, claims, or drawings, should be understood to contemplate the possibilities of including one of the terms, either of the terms, or both terms. For example, the phrase "A or B" should be understood to include the possibilities of "A" or "B" or "A and B."

Figure 1:
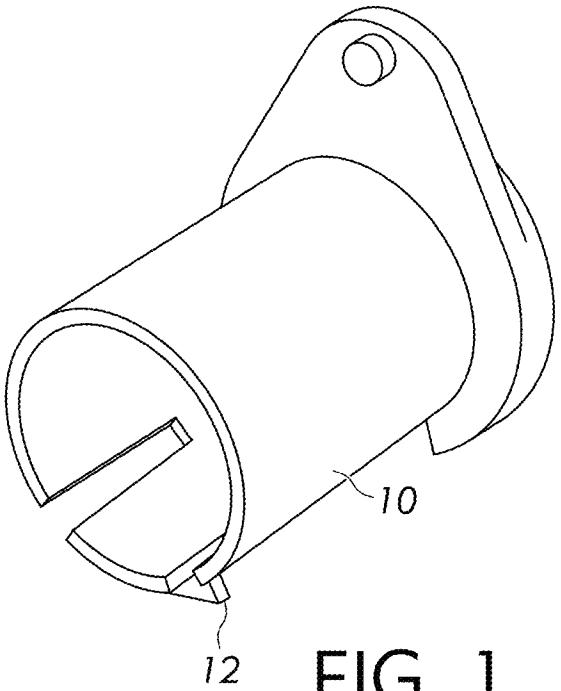
FIG. 1 shows a spindle.

FIG. 1 shows an example spindle 10 for supporting a welding wire spool. The spindle 10 can be part of a welding machine, wire feeder, or reel stand for example. The spindle 10 has a finger 12 that projects radially to engage the hub or flange of a welding wire spool and capture it on the spindle. The finger is located at a standard axial distance (e.g., 2.125 inches) along the spindle 10 so as to be compatible with wire spools having standard dimensions, such as a standard hub width (e.g., 2.125 inches). The finger 12 is designed to grab the hub of the welding wire spool.

FIG. 2 shows a standard eight inch diameter welding wire spool having a hub 14 that is 2.125 inches wide and is flush with both spool flanges. A length of welding wire is wound on the barrel of the spool between the flanges. The finger 12 on the spindle 10 (FIG. 1) is located axially along the spindle to grab the hub 14 of the spool and keep the spool from sliding axially off of the spindle. The spool can be moved back-and-forth between two spindles on opposite sides of a wire feeder or reel stand without the spool having to be flipped over in order to maintain the wire payout direction (either clockwise or counterclockwise). The spool can also be flipped over on a given spindle to change the wire payout direction if desired.

Figure 3:
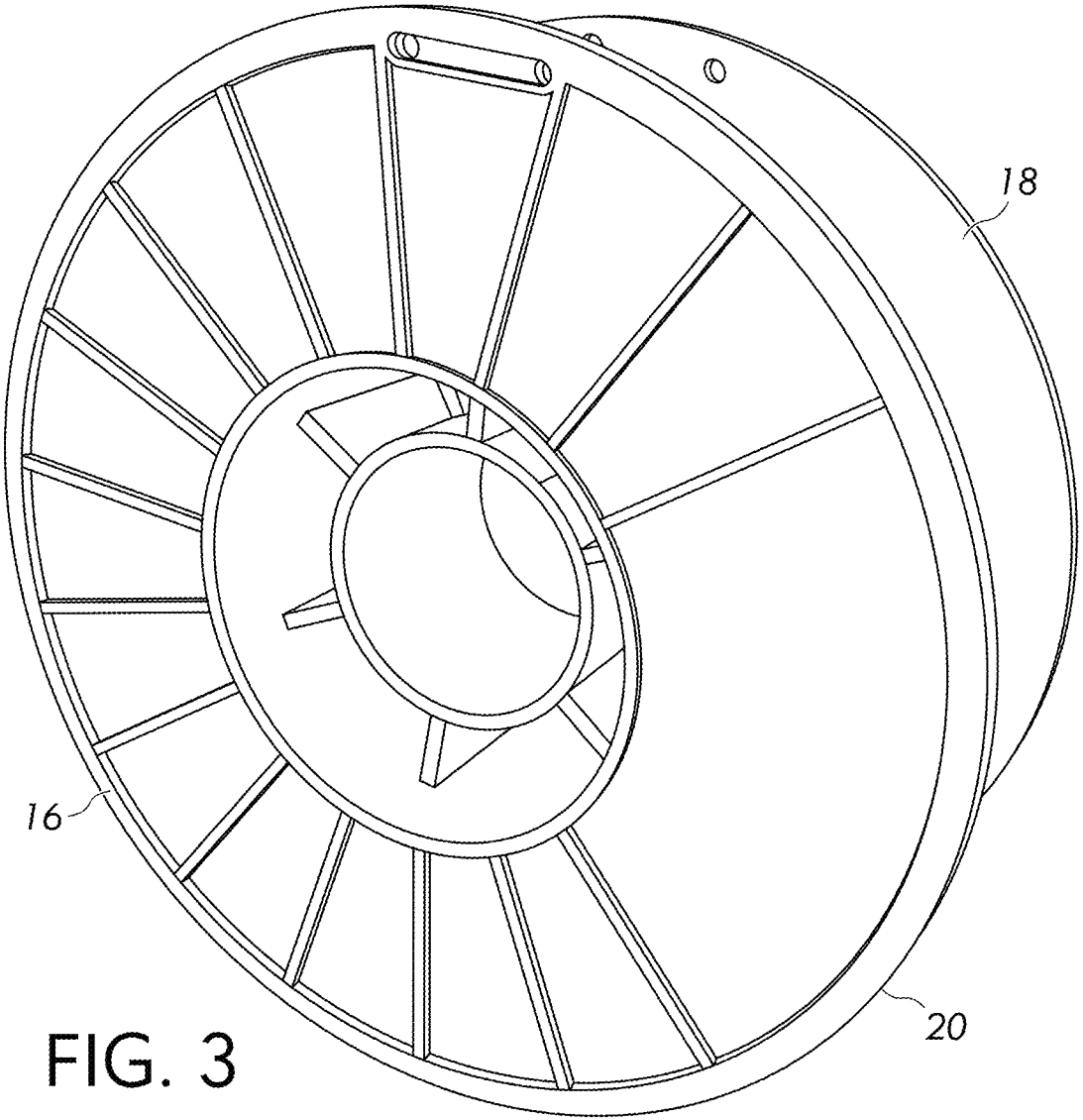
FIG. 3 shows a spool.

FIG. 3 shows a higher capacity eight inch diameter spool 16. The spool is wider (e.g., 2.875 inches) than the spool shown in FIG. 2. However, the hub is not wider than the hub shown in FIG. 2. The hub is designed to be mounted on a standard wire feeder spindle. The hub is flush with the flange 18 that faces away in FIG. 3, and is recessed (e.g., 0.75 inches) from the flange 20 facing the view of FIG. 3. Because the hub is a standard width and is recessed from the flange 20 as shown, it can be captured on a standard spindle as shown in FIG. 1. However, the hub is not symmetrical, and the spool 16 cannot be flipped over on a spindle to change the wire payout direction. Further, the spool 16 would need to be flipped over when moved to a spindle extending axially on the opposite side of a wire feeder or reel stand. Flipping the spool 16 when moving it to the opposite side of the wire feeder or reel stand changes the wire payout direction, which may not be desired.

FIGS. 4 through 7 show a higher capacity spool 22 (e.g., wider than the standard 2.125 inch width) with a movable or sliding hub 24. The spool 22 has first and second flanges 26, 28 and a barrel 30 extending between the flanges. The flanges 26, 28 surround the barrel 30 and a length of wire or line, such as welding wire, can be wound on the barrel 30 between the flanges 26, 28. The barrel 30 is axially wider than the movable hub 24, and the movable hub can be configured to mount on a standard spindle. For example, the movable hub 24 can be 2.125 inches wide to mount on a standard welding wire feeder spindle; however, the movable hub could have various widths and sizes suitable for a particular application.

Figure 5:
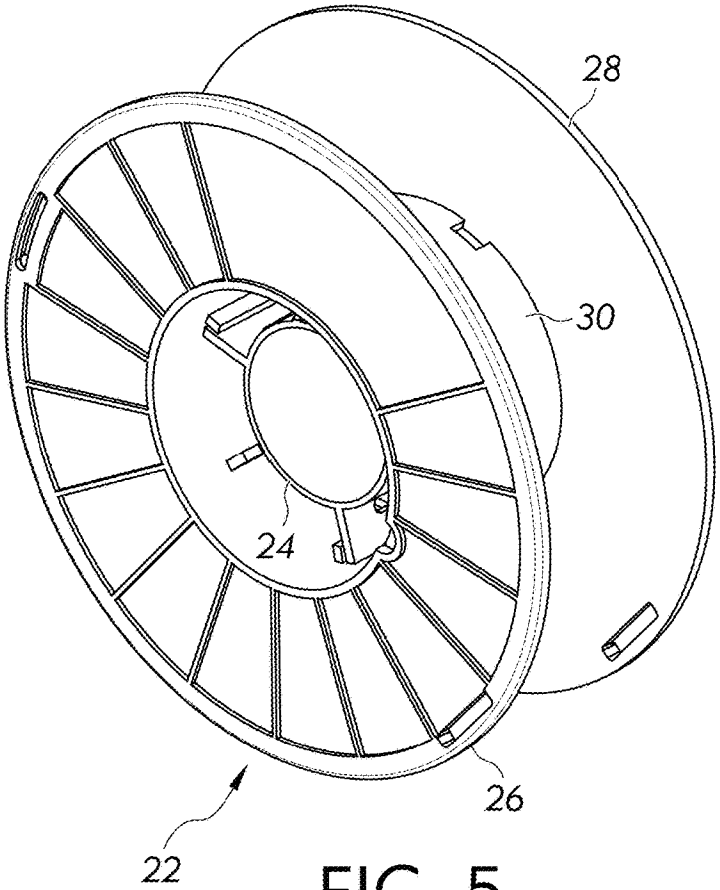
FIG. 5 shows the spool with the movable hub.
Figure 4:
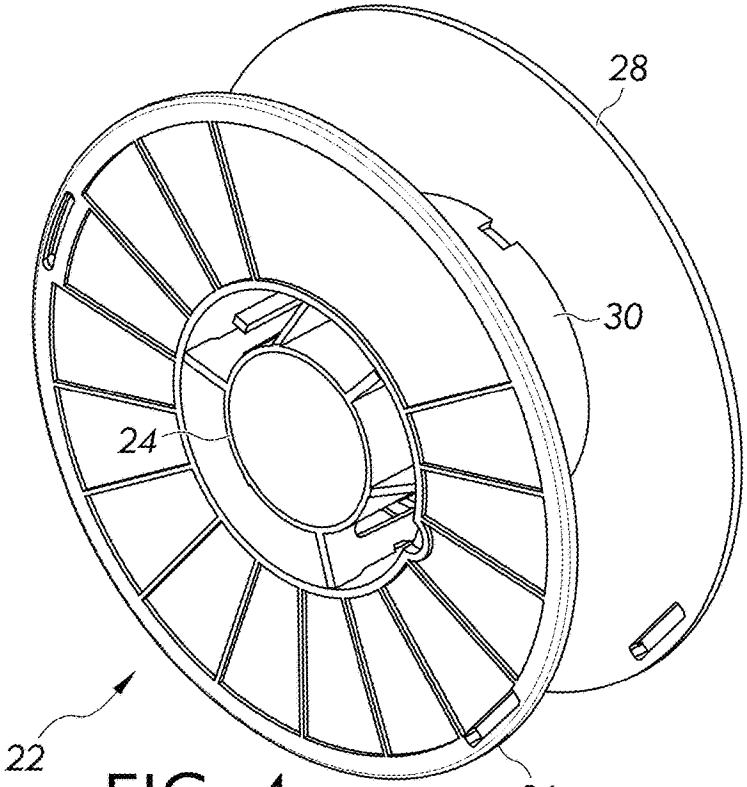
FIG. 4 shows a spool with a movable hub.
Figure 7:
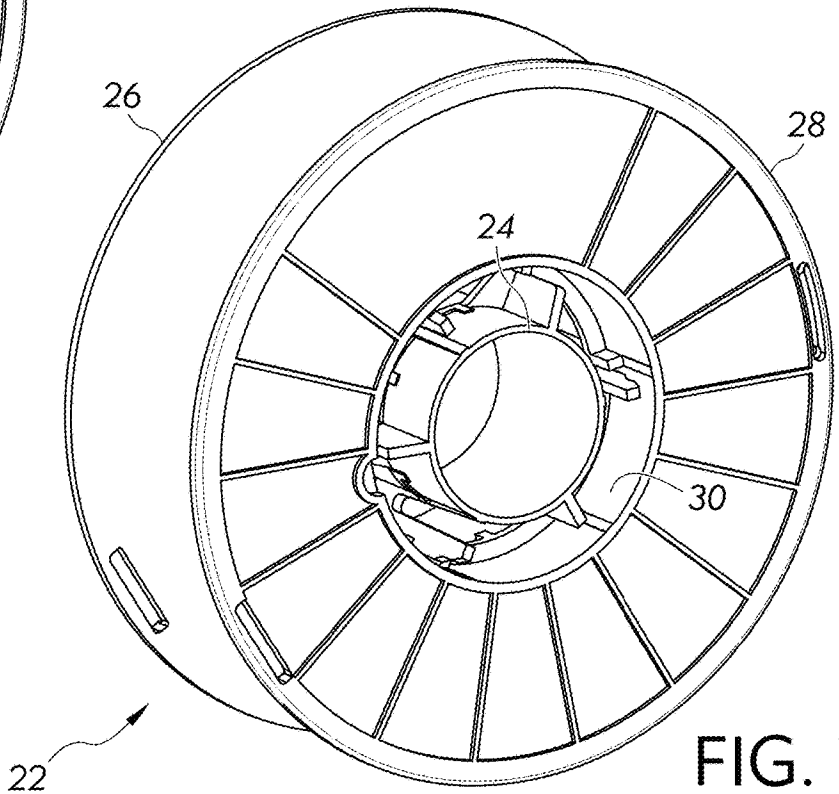
FIG. 7 shows the spool with the movable hub.
Figure 6:
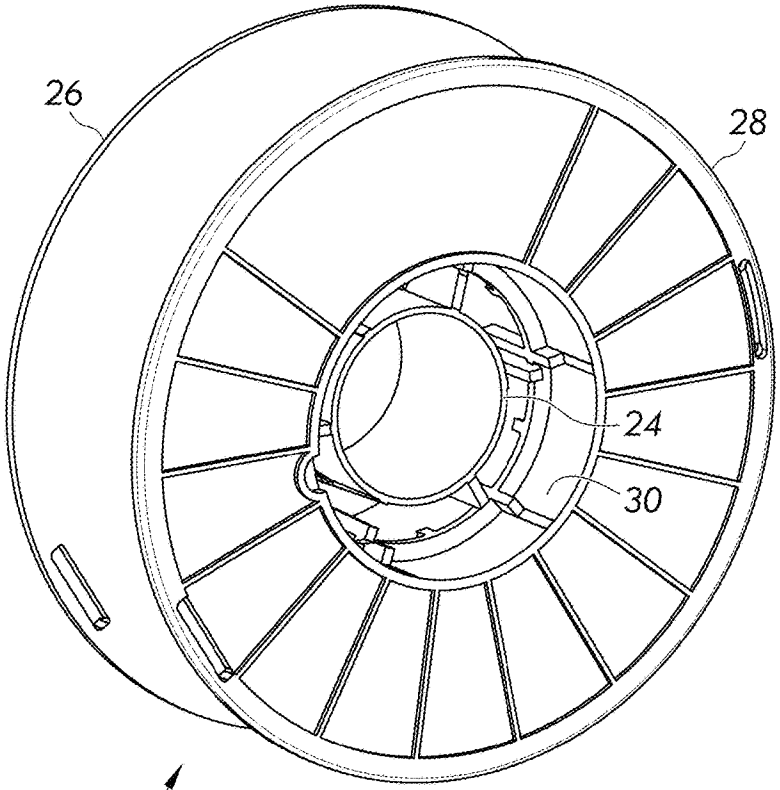
FIG. 6 shows the spool with the movable hub.

The movable hub 24 is located radially inward of the barrel 30 and is axially movable between a first operational position adjacent the first flange 26 and a second operational position adjacent the second flange 28. The movable hub 24 is axially movable within the barrel 30 but is generally captive within the barrel. FIGS. 4 and 6 show the movable hub 24 in the first operational position adjacent the first flange 26 and FIGS. 5 and 7 show the movable hub in the second operational position adjacent the second flange 28. As will be explained below, the spool 22 employs positioning detents and stop surfaces to position the movable hub 24 at either of the operational positions. In FIGS. 4 and 6, the movable hub 24 is flush with the first flange 26 when in the first operational position, but is recessed from the second flange 28. In FIGS. 5 and 7, the movable hub 24 is flush with the second flange 28 when in the second operational position, but is recessed from the first flange 26. However, the movable hub 24 need not be flush with either flange 26, 28 when in an operational position. For example, in certain embodiments, the hub 24 can project slightly beyond a flange when in an operational position, or be recessed from both flanges when in an operational position.

In the embodiment shown, the movable hub 24 can be moved back and forth axially between flush positions adjacent either of the spool flanges 26, 28. This allows the spool 22 to be moved between opposite spindles on a wire feeder or reel stand without requiring the spool to be flipped over, and allows the spool to be flipped over on a spindle to reverse the payout direction. Unlike conventional higher-capacity, (e.g., eight inch diameter) welding wire spools, the present spool 22 does not need to maintain a common or consistent flange adjacent the wire feeder or reel stand. Either flange 26, 28 can be adjacent the wire feeder or reel stand and the movable hub 24 can be recessed with respect to either outer flange, so that the spindle can capture the hub regardless of which side of the wire feeder/reel stand that the spool 22 is mounted on.

Figure 8:
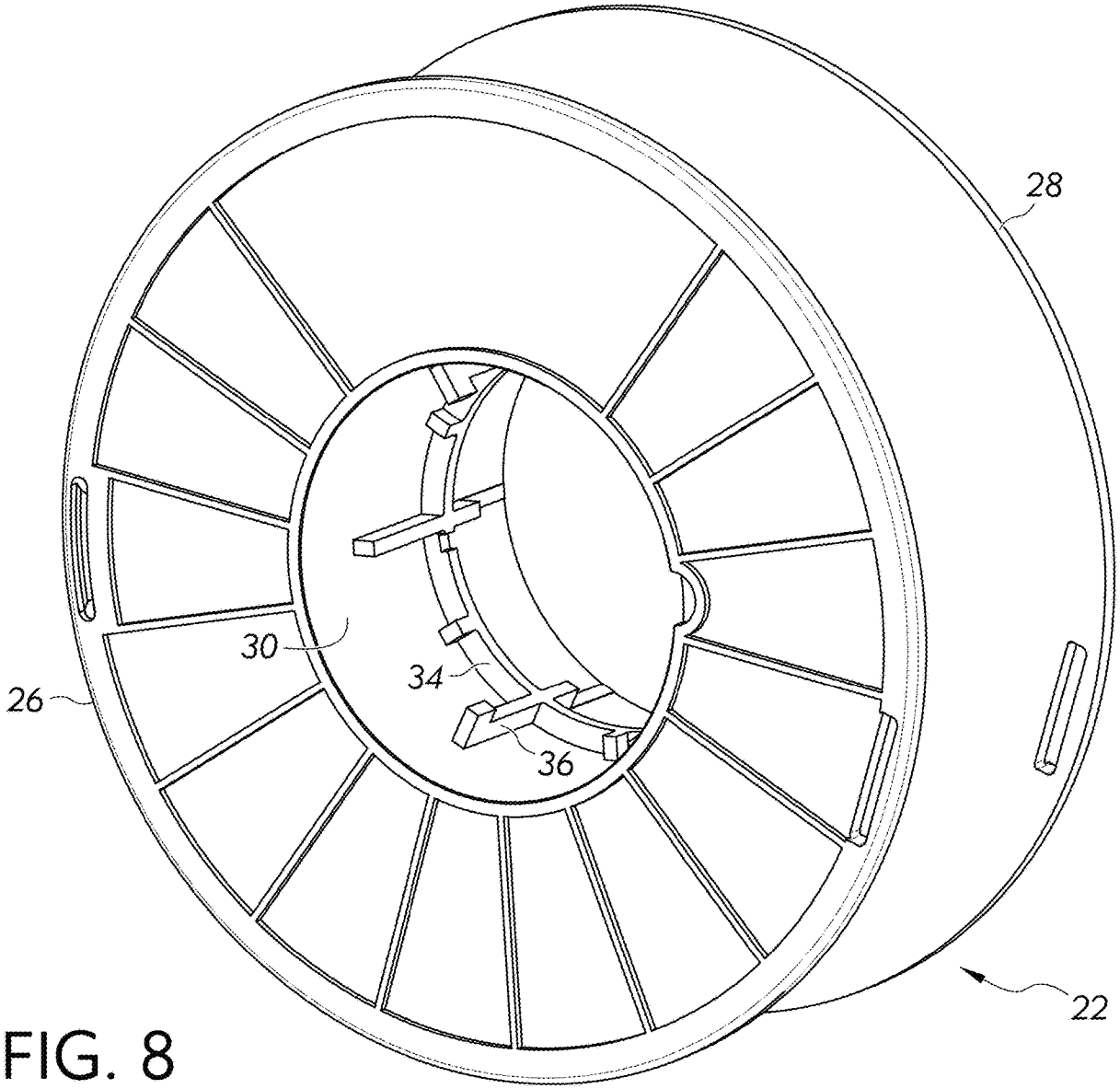
FIG. 8 shows the spool with the movable hub removed.
Figure 9:
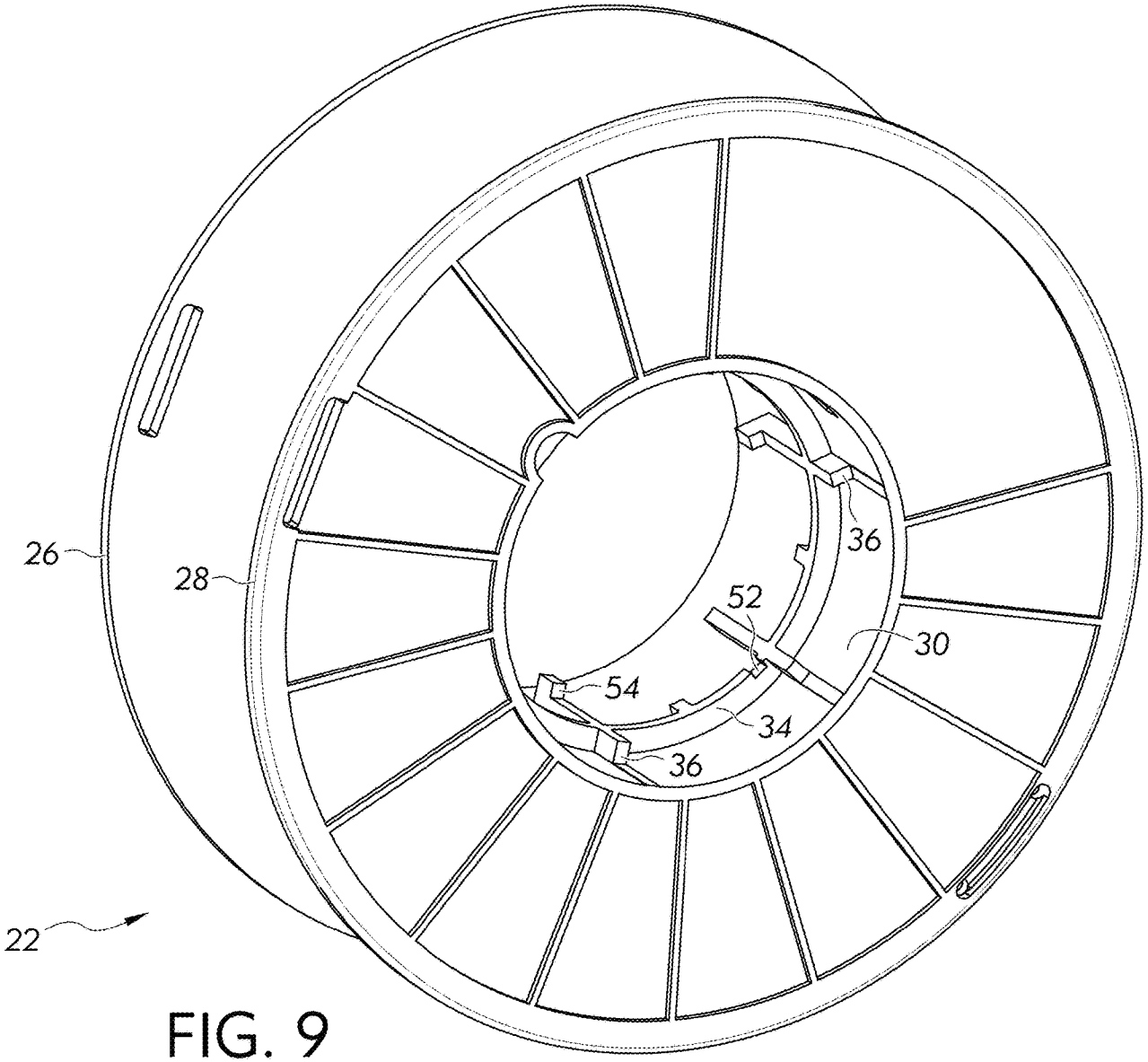
FIG. 9 shows the spool with the movable hub removed.
Figure 10:
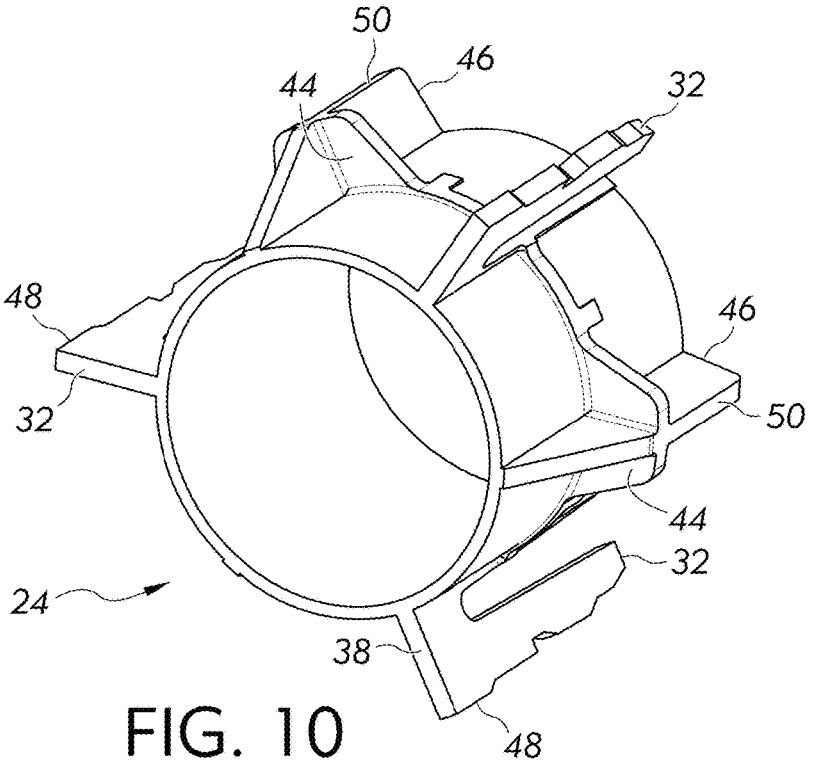
FIG. 10 shows the movable hub separate from the spool.
Figure 11:
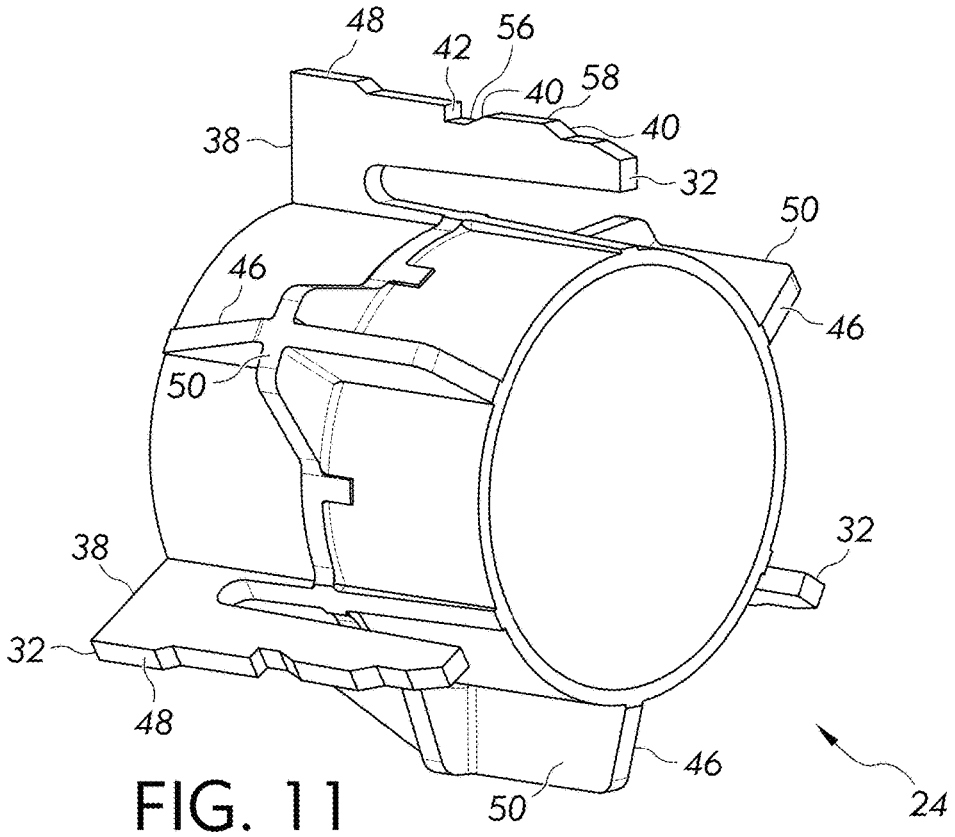
FIG. 11 shows the movable hub separate from the spool.

FIGS. 8 and 9 show the spool 22 and details of the inner surface of the barrel 30 with the movable hub removed. FIGS. 10 and 11 show the movable hub 24. The movable hub 24 includes a plurality of axially-extending cantilevered detent or spring arms 32 that engage corresponding structural elements on the inner surface of the barrel 30 of the spool 22. The structural elements on the barrel 30 can include rib elements that project radially inward from the inner surface of the barrel 30 toward the movable hub 22. The rib elements on inner surface of the barrel 30 can include one or more annular ribs 34, axial ribs 36, or similar inwardly-projecting surfaces. The annular rib 34 shown in the drawings surrounds the hub 24, but it is merely exemplary. The rib need not be ring-shaped, but could be broken into several arc-shaped projections spaced along the inner circumference of the barrel 30.

The axially-extending cantilevered detent or spring arms 32 extend in a direction generally parallel to the axis of the spool 22. The spring arms 32 are cantilevered from a hinge portion 38 and are formed from an elastic material, such as a plastic, so as to be flexible. During axial movement of the hub 24 within the barrel 30 toward either of its operational positions, the spring arms 32 of the hub interact with the annular rib 34 on the barrel, which flexes the spring arms radially downward. When the arms 32 are flexed downward they act as springs and apply radially-outward bias forces to the barrel 30 through the annular rib 34. The spring action of the arms 32, along with their contoured surfaces, helps to hold the hub 24 in a desired operational position within the barrel 30 of the spool 22.

The spring arms 32 include sloping cam surfaces 40 that resist the axial movement of the hub 24 back and forth within the barrel 30. The cam surfaces 40 interact with annular rib 34 on the barrel 30 to cause the spring arms 32 to flex radially as the hub 24 is axially translated (e.g., inward and outward) within the spool 22. The spring arms 32 and/or other portions of the hub 24 can also include stop surfaces 42, 44 that interfere with corresponding structural elements on the barrel 30 (e.g., the annular rib 34 and/or the axial ribs 36) to limit the axial movement of the hub within the spool 22. For example, the stop surfaces 42, 44 can prevent the hub 24 from being moved axially beyond either of the hub's operational positions within the barrel 30. In the example embodiment shown, the stop surfaces 42 on the spring arms 32 are shoulders that limit the axial movement of the hub 24 toward the second flange 28 and prevent the hub from being moved past the second operational position shown in FIGS. 5 and 7. The stop surfaces 44 limit the axial movement of the hub 24 toward the first flange 26 and prevent the hub from being moved past the first operational position shown in FIGS. 4 and 6.

In certain embodiments, the plurality of axially-extending cantilevered detent or spring arms 32 are arranged symmetrically around the movable hub 24. For example, the hub 24 could include three spring arms 32 spaced 120 degrees apart around the circumference of the hub. Fewer or more than three spring arms 32 could be provided on the hub 24. The hub 24 can also include a plurality of radially and axially-extending strengthening ribs 46 spaced symmetrically around the hub. In the example embodiment shown, the hub 24 includes three strengthening ribs 46 located 120 degrees apart, and each strengthening rib is located between two spring arms 32. Fewer or more than three strengthening ribs 46 could be provided on the hub 24. The strengthening ribs 46 can include stop surfaces 44 that interfere with corresponding structural elements on the barrel 30. The spring arms 32 and/or strengthening ribs 46 can form spokes between the movable hub 24 and the barrel 30. In the example embodiment shown, to form spokes between the hub 24 and barrel 30, the radially-outermost surfaces 48 of the spring arms 32 contact the inner circumferential surface of the barrel 30, and the radially-outermost surfaces 50 of the strengthening ribs 46 contact the annular rib 34 and/or the axial ribs 36.

The radially inwardly-projecting structures along the inner surface of the barrel 30, such as the annular rib 34 and the axial ribs 36, can help to retain and properly align the movable hub 24 within the spool 22, prevent it from rotating relative to the spool, and transfer forces from the hub to the barrel 30. The annular rib 34 includes notches 52 that receive the spring arms 32 of the movable hub 24. The notches 52 prevent the hub 24 from rotating relative to the spool/barrel and "clocks" the rotation of the hub within the spool. The spring arms 32 ride in the notches 52 as the hub 24 is moved axially back and forth within the barrel 30.

To insert and capture the hub 24 within the spool 22, the hub can be rotated so that the spring arms 32 are not aligned with the notches 52, and so that the strengthening ribs 46 and stop surfaces 44 on the hub clear the axial ribs 36 on the barrel 30. The hub 24 can be pushed axially so that the spring arms 32 contact the annular rib 34 and are flexed downward. The hub 24 can then be rotated to allow the spring arms 32 to flex upward into the notches 52. As the hub 24 is rotated, the stop surfaces 44 on the hub's strengthening ribs 46 can be rotated to overlap the inward radial projections or fingers on the barrel's 30 axial ribs 36. The inward radial projections on the axial ribs 36 provide stop surfaces 54 that limit the axial movement of the hub 24 toward the first flange 26, and prevent the hub from being moved past the first operational position, by contacting the stop surfaces 44 on the strengthening ribs 46. The inward radial projections providing the stop surfaces 54 of the axial ribs 36 are axially offset (e.g., closer to a flange) from the annular rib 36.

The surface of the annular rib 34 that faces the stop surfaces 54 also provides a stop surface. This additional stop surface is best shown in FIG. 8. The stop surface on the annular rib 34 limits the axial movement of the hub 24 toward the second flange 28, and prevents the hub from being moved past the second operational position, by contacting the stop surfaces 42 on the spring arms 32 as the hub 24 is moved axially toward the second flange.

To help keep the hub 24 in either of the two operational positions and resist axial movement therefrom, the hub includes a detent 56 and the cam surfaces 40. The spring arms 32 act like cantilever springs. Radial bias force pushes the cam profile of the spring arms 32 out into the notches 52, which can act like cam followers. Moving the hub 24 takes an application of axial force to drive the cam profiles of the spring arms 32 up the locking angle, which compresses the cantilever spring. The cam surfaces 40 on the spring arms 32 interact with the respective notches 52 on the annular rib 36 to flex the spring arms during the axial movement of the movable hub 24. Once the hub 24 has slid the length of the flat portion 58 of the cam profile, the cantilever can flex back out as the notch 52 slides down the cam profile of the cam surface 40, positioning and locking the hub on the opposite side of the spool. Each of the spring arms 32 includes at least one detent 56 and cam surfaces 40 for positioning the movable hub 24 at a desired operational position.

Figure 13:
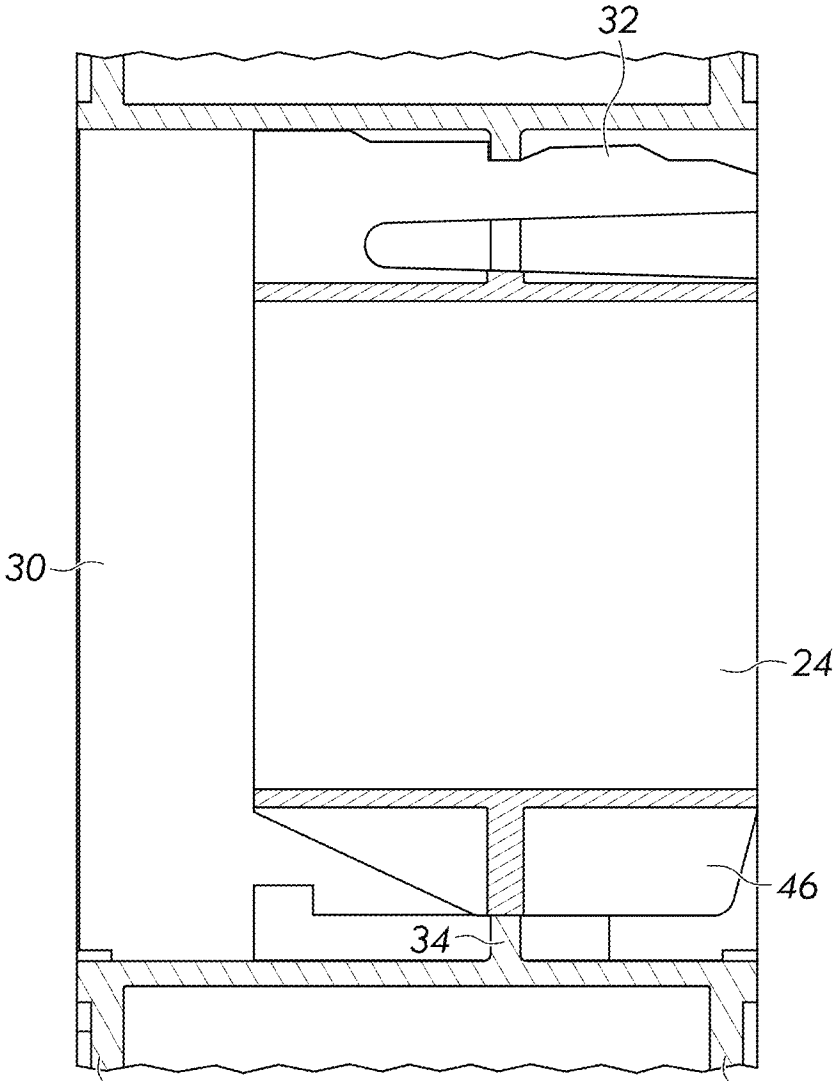
FIG. 13 is a cross-section of the spool with the movable hub.
Figure 12:
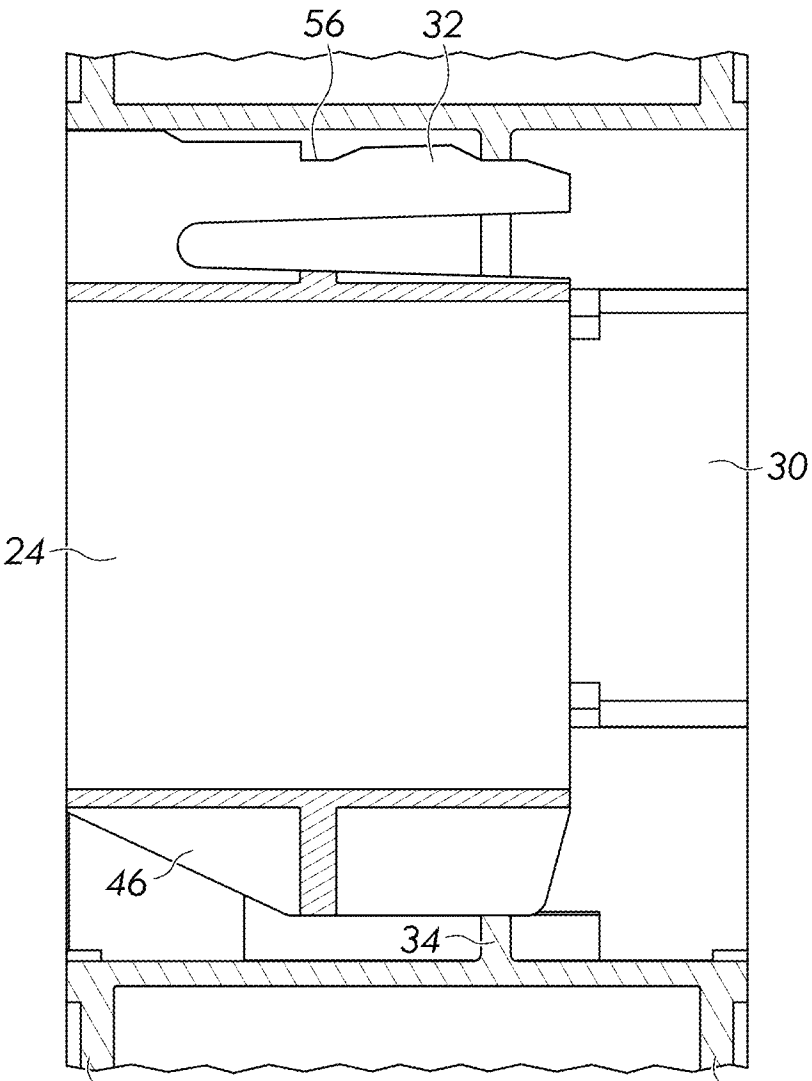
FIG. 12 is a cross-section of the spool with the movable hub.

FIG. 12 is a cross-sectional view that shows the hub 24 in the first operational position adjacent the first flange 26. FIG. 13 is a cross-sectional view that shows the hub 24 in the second operational position adjacent the second flange 28. It can be seen that the annular rib 34 is located closer to the second flange 28 than the first flange 26. However, the annular rib 34 could be centrally located within the barrel 30 if desired, or located closer to the first flange 26 than the second flange 28.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A spool, comprising:

a first flange;

a second flange;

a barrel extending between the first flange and the second flange; and a movable hub located radially inward of the barrel, wherein the barrel is axially wider than the movable hub and the movable hub is axially movable between a first operational position adjacent the first flange and a second operational position adjacent the second flange, wherein the movable hub includes an axially-extending cantilevered detent arm forming a stop surface that limits axial movement of the movable hub toward one of the first flange and the second flange.

2. The spool of claim 1, wherein the movable hub includes a plurality of axially-extending cantilevered detent arms forming spokes between the movable hub and the barrel.

3. The spool of claim 2, wherein the axially-extending cantilevered detent arms are spaced 120 degrees apart around the movable hub.

4. The spool of claim 2, wherein the movable hub includes a radially-projecting rib between each of the axially-extending cantilevered detent arms, and wherein each radially-projecting rib forms a further stop surface that limits axial movement of the movable hub toward the other one of the first flange and the second flange.

5. The spool of claim 4, wherein the movable hub is flush with the first flange when in the first operational position and flush with the second flange when in the second operational position.

6. The spool of claim 1, wherein an inner surface of the barrel includes a rib having a notch that receives the axially-extending cantilevered detent arm and restricts rotation of the movable hub within the barrel.

7. The spool of claim 6, wherein the axially-extending cantilevered detent arm includes a plurality of cam surfaces that interact with the notch to flex the axially-extending cantilevered detent arm during the axial movement of the movable hub.

8. The spool of claim 7, wherein the rib is an annular rib, and wherein the inner surface of the barrel further includes an inward radial projection forming a further stop surface that limits axial movement of the movable hub toward the other one of the first flange and the second flange, wherein the inward radial projection is axially offset from the annular rib.

9. A welding wire spool, comprising:

a barrel;

a first flange surrounding the barrel;

a second flange surrounding the barrel;

a length of welding wire wound on the barrel between the first flange and the second flange; and a movable hub located radially inward of the barrel, wherein the barrel is axially wider than the movable hub and the movable hub is axially movable between a first operational position adjacent the first flange and a second operational position adjacent the second flange, wherein the movable hub includes an axially-extending spring arm that applies a radial bias force to the barrel during axial movement of the movable hub.

10. The welding wire spool of claim 9, wherein the movable hub includes a plurality of axially-extending spring arms forming spokes between the movable hub and the barrel.

11. The welding wire spool of claim 10, wherein the axially-extending spring arms are spaced 120 degrees apart around the movable hub.

12. The welding wire spool of claim 10, wherein the axially-extending spring arms each include a detent for positioning the movable hub at one or both of the first operational position and the second operational position.

13. The welding wire spool of claim 10, wherein each of the axially-extending spring arms includes a stop surface that limits axial movement of the movable hub toward one of the first flange and the second flange, wherein the movable hub includes a radially-projecting rib between each of the axially-extending spring arms, and wherein each radially-projecting rib forms a further stop surface that limits axial movement of the movable hub toward the other one of the first flange and the second flange.

14. The welding wire spool of claim 13, wherein the movable hub is flush with the first flange when in the first operational position and flush with the second flange when in the second operational position.

15. The welding wire spool of claim 9, wherein an inner surface of the barrel includes a rib having a notch that receives the axially-extending spring arm and restricts rotation of the movable hub within the barrel.

16. The welding wire spool of claim 15, wherein the axially-extending spring arm includes a plurality of cam surfaces that interact with the notch to flex the axially-extending spring arm during the axial movement of the movable hub.

17. A spool, comprising:

a first flange;

a second flange;

a barrel extending between the first flange and the second flange; and a movable hub located radially inward of the barrel, wherein the barrel is axially wider than the movable hub and the movable hub is axially movable between a first operational position adjacent the first flange and a second operational position adjacent the second flange, wherein the movable hub includes an axially-extending spring arm that applies a radial bias force to the barrel during axial movement of the movable hub, and wherein the barrel includes a stop surface that limits the axial movement of the movable hub toward one of the first flange and the second flange.

18. The spool of claim 17, wherein the movable hub includes a plurality of axially-extending spring arms forming spokes between the movable hub and the barrel.

19. The spool of claim 18, wherein the axially-extending spring arms are spaced 120 degrees apart around the movable hub.

20. The spool of claim 18, wherein the axially-extending spring arms each include a detent for positioning the movable hub at one or both of the first operational position and the second operational position.

21. The spool of claim 17, wherein the movable hub is flush with the first flange when in the first operational position and flush with the second flange when in the second operational position.

22. The spool of claim 17, wherein an inner surface of the barrel includes a rib having a notch that receives the axially-extending spring arm and restricts rotation of the movable hub within the barrel.

23. The spool of claim 22, wherein the axially-extending spring arm includes a plurality of cam surfaces that interact with the notch to flex the axially-extending spring arm during the axial movement of the movable hub.

24. The spool of claim 23, wherein the rib is an annular rib that surrounds the movable hub.

* * * * *